US005736998A

United States Patent [19]

Caren et al.

[11] Patent Number: 5,736,998

[45] Date of Patent: Apr. 7, 1998

[54] INKJET CARTRIDGE DESIGN FOR FACILITATING THE ADHESIVE SEALING OF A PRINTHEAD TO AN INK RESERVOIR

[75] Inventors: Michael P. Caren, Palo Alto; Max Stephen Gunther; John C. Nadworny, both of San Diego, all of Calif.

[73] Assignee: Hewlett-Packard Company, Palo Alto, Calif.

[21] Appl. No.: 398,849

[22] Filed: Mar. 6, 1995

[51] Int. Cl.[6] ..... B41J 2/135

[52] U.S. Cl. ..... 347/45; 347/63

[58] Field of Search ..... 347/45, 63, 64, 347/65; 156/60

[56] References Cited

U.S. PATENT DOCUMENTS

| | | |
|---|---|---|
| 4,312,009 | 1/1982 | Lange . |
| 4,450,455 | 5/1984 | Sugitani et al. . |
| 4,490,728 | 12/1984 | Vaught et al. . |
| 4,500,895 | 2/1985 | Buck et al. . |
| 4,502,060 | 2/1985 | Rankin et al. . |
| 4,550,326 | 10/1985 | Allen et al. . |
| 4,558,333 | 12/1985 | Sugitani et al. . |
| 4,568,953 | 2/1986 | Aoki et al. . |
| 4,580,149 | 4/1986 | Domoto et al. . |
| 4,587,534 | 5/1986 | Saito et al. . |
| 4,611,219 | 9/1986 | Sugitani et al. . |

(List continued on next page.)

FOREIGN PATENT DOCUMENTS

| | | |
|---|---|---|
| 0309146A2 | 3/1989 | European Pat. Off. . |
| 0367541A2 | 5/1990 | European Pat. Off. . |
| 62-170350 | 7/1987 | Japan ..... B41J 3/04 |

OTHER PUBLICATIONS

Gary L. Seiwell, et al., "The ThinkJet Orifice Plate: A Part With Many Functions," May 1985, Hewlett-Packard Journal, pp. 33–37.

J. I. Crowley, et al., "Nozzles For Ink Jet Printers," IBM Technical Disclosure Bulletin, vol. 25, No. 8, Jan. 1983.

J. T. C. Yeh, "Laser Ablation Of Polymers," J. Vac. Sci. Tech. May/Jun. 86, pp. 653–658.

(List continued on next page.)

*Primary Examiner*—Valerie Lund

*Attorney, Agent, or Firm*—Dennis G. Stenstrom

[57] ABSTRACT

This disclosure describes an improved ink seal between a print cartridge body and an inkjet printhead. In a preferred embodiment, a nozzle member containing an array of orifices has a substrate, having heater elements formed thereon, affixed to a back surface of the nozzle member. Each orifice in the nozzle member is associated with a single heating element formed on the substrate. The back surface of the nozzle member extends beyond the outer edges of the substrate. Ink is supplied from an ink reservoir to the orifices by a fluid channel within a barrier layer between the nozzle member and the substrate. The fluid channel in the barrier layer may receive ink fl owing around two or more outer edges of the substrate or may receive ink which flows through a hole in the center of the substrate. The nozzle member is adhesively sealed with respect to the ink reservoir body by forming an ink seal circumscribing the substrate, between the back surface of the nozzle member and the headland area of the print cartridge. This method and structure for a print cartridge headland for providing a seal directly between a nozzle member and an ink reservoir body has many advantages over other methods of providing a seal between a printhead and the ink reservoir body. One advantage is that such a structure reduces the occurrence of clogged nozzles during the adhesive sealing process. Another advantage is that there is a reduced occurrence of adhesive voids where the adhesive seal acts to encapsulate and protect the traces near the substrate which may come in contact with ink. A further advantage is that it is easier to control adhesive flow and bulges due to varying amounts and placement of adhesive. The above advantages provide reduced yield losses, and thus lower manufacturing costs, when manufacturing thermal inkjet print cartridges.

24 Claims, 15 Drawing Sheets

U.S. PATENT DOCUMENTS

| | | | |
|---|---|---|---|
| 4,683,481 | 7/1987 | Johnson . | |
| 4,695,854 | 9/1987 | Cruze-Uribe . | |
| 4,712,172 | 12/1987 | Kiyohara et al. . | |
| 4,734,717 | 3/1988 | Rayfield . | |
| 4,746,935 | 5/1988 | Allen . | |
| 4,773,971 | 9/1988 | Lam et al. . | |
| 4,780,177 | 10/1988 | Wojnarowski et al. . | |
| 4,842,677 | 6/1989 | Wojnarowski et al. . | |
| 4,847,630 | 7/1989 | Bhaskar et al. . | |
| 4,915,981 | 4/1990 | Traskos et al. . | |
| 4,926,197 | 5/1990 | Childers et al. . | |
| 4,942,408 | 7/1990 | Braun . | |
| 5,198,834 | 3/1993 | Childers et al. . | |
| 5,278,584 | 1/1994 | Keefe et al. | 347/65 |
| 5,484,500 | 1/1996 | Kaufmann et al. | 156/198 |

OTHER PUBLICATIONS

Nielsen, Niels J., "History of ThinkJet Printhead Development," Hewlett–Packard Journal, May 1985, pp. 4–7.

Thomas A. Znotins, et al., "Excimer Lasers: An Emerging Technology in Materials Processing," Laser Focus Electro Optics, May 1987, pp. 54–70.

V. Srinivasan, et al., "Excimer Laser Etching Of Polymers," Department of Chemical Engineering, Clarkson University, Potsdam, New York, received Dec. 30, 1985; accepted for publication, Feb. 19, 1986.

R. Srinivasan, et al., "Self–Developing Photoetching Of Poly(ethylene terephthalate) Films by Far–Ultraviiolet Excimer Laser Radiation," IBM Thomas J. Watson Research Center, Yorktown Heights, New York; recieved May 10, 1982; accepted for publication Jul. 2, 1982.

R. Srinivasan, "Kinetics of the Ablative Photodecomposition of Organic Polymers in the Far Ultraviolet," IBM Thomas J. Watson Research Center, Yorktown Heights, New York; received Mar. 21, 1983; accepted for publication Jun. 24, 1983.

INKJET CARTRIDGE DESIGN FOR FACILITATING THE ADHESIVE SEALING OF A PRINTHEAD TO AN INK RESERVOIR

CROSS-REFERENCE TO RELATED APPLICATIONS

This application relates to the subject matter disclosed in the following U.S.33 Patents and co-pending U.S. Applications:

U.S. application Ser. No. 07/864,896, filed Apr. 2, 1992, entitled "Adhesive Seal for an Inkjet Printhead;"

U.S. application Ser. No. 07/862,668, filed Apr. 2, 1992, entitled "Integrated Nozzle Member and TAB Circuit for Inkjet Printhead;"

U.S. Pat. No. 5,278,584 to Keefe, et al., entitled "Ink Delivery System for an Inkjet Printhead;"

U.S. application Ser. No. 08/179,866, filed Jan. 11, 1994 entitled "Ink Delivery System for an Inkjet Printhead,"

U.S. Pat. No. 4,926,197 to Childers, entitled "Plastic Substrate for Thermal Ink Jet Printer;"

U.S. application Ser. No. 07/862,669, filed Apr. 2, 1992, entitled "Nozzle Member Including Ink Flow Channels;"

U.S. application Ser. No. 07/864,822, filed Apr. 2, 1992, entitled "Improved Inkjet Printhead;"

U.S. application Ser. No. 08/236,915, filed Apr. 29, 1994, entitled "Thermal Inkjet Printer Printhead;"

The above patent and co-pending applications are assigned to the present assignee and are incorporated herein by reference.

FIELD OF THE INVENTION

The present invention generally relates to inkjet and other types of printers and, more particularly, to the printhead portion of an inkjet printer.

BACKGROUND OF THE INVENTION

Thermal inkjet print cartridges operate by rapidly heating a small volume of ink to cause the ink to vaporize and be ejected through one of a plurality of orifices so as to print a dot of ink on a recording medium, such as a sheet of paper. Typically, the orifices are arranged in one or more linear arrays in a nozzle member. The properly sequenced ejection of ink from each orifice causes characters or other images to be printed upon the paper as the printhead is moved relative to the paper. The paper is typically shifted each time the printhead has moved across the paper. The thermal inkjet printer is fast and quiet, as only the ink strikes the paper. These printers produce high quality printing and can be made both compact and affordable.

An inkjet printhead generally includes: (1) ink channels to supply ink from an ink reservoir to each vaporization chamber proximate to an orifice; (2) a metal orifice plate or nozzle member in which the orifices are formed in the required pattern; and (3) a silicon substrate containing a series of thin film resistors, one resistor per vaporization chamber.

To print a single dot of ink, an electrical current from an external power supply is passed through a selected thin film resistor. The resistor is then heated, in turn superheating a thin layer of the adjacent ink within a vaporization chamber, causing explosive vaporization, and, consequently, causing a droplet of ink to be ejected through an associated orifice onto the paper.

In an inkjet printhead described in U.S. Pat. No. 4,683,481 to Johnson, entitled "Thermal Ink Jet Common-Slotted Ink Feed Printhead," ink is fed from an ink reservoir to the various vaporization chambers through an elongated hole formed in the substrate. The ink then flows to a manifold area, formed in a barrier layer between the substrate and a nozzle member, then into a plurality of ink channels, and finally into the various vaporization chambers. This design may be classified as a "center" feed design, whereby ink is fed to the vaporization chambers from a central location then distributed outward into the vaporization chambers. To seal the back of the substrate with respect to an ink reservoir so that ink flows into the center slot but is prevented from flowing around the sides of the substrate in a "center feed" design, a seal is formed, circumscribing the hole in the substrate, between the substrate itself and the ink reservoir body. Typically, this ink seal is accomplished by dispensing an adhesive bead around a fluid channel in the ink reservoir body, and positioning the substrate on the adhesive bead so that the adhesive bead circumscribes the hole formed in the substrate. The adhesive is then cured with a controlled blast of hot air, whereby the hot air heats up the substrate and adhesive, thereby curing the adhesive. This method requires quite a bit of time and thermal energy, since the heat must pass through a relatively thick substrate before heating up the adhesive. Further, because the seal line is under the substrate, it tends to be difficult to diagnose the cause of any ink leakage.

In an inkjet printhead described in U.S. Pat. No. 5,278,584 to Keefe, et al., entitled "Ink Delivery System for an Inkjet Printhead" and U.S. application Ser. No. 08/179,866, filed Jan. 11, 1994 entitled "Improved Ink Delivery System for an Inkjet Printhead," ink flows around the edges of the substrate and directly into ink the channels and then through the ink channels into the vaporization chambers. This "edge feed" design has a number of advantages over previous "center" feed printhead designs. One advantage is that the substrate or die width can be made narrower, due to the absence of the elongated central hole or slot in the substrate. Not only can the substrate be made narrower, but the length of the edge feed substrate can be shorter, for the same number of nozzles, than the center feed substrate due to the substrate structure now being less prone to cracking or breaking without the central ink feed hole. This shortening of the substrate enables a shorter headland and, hence, a shorter print cartridge snout. This is important when the print cartridge is installed in a printer because with a shorter print cartridge snout, the star wheels can be located closer to the pinch rollers to ensure better paper/roller contact along the transport path of the print cartridge snout. There are also a number of performance advantages to the edge feed design.

In U.S. application Ser. No. 07/862,668, filed Apr. 2, 1992, entitled "Integrated Nozzle Member and TAB Circuit for Inkjet Printhead," a novel nozzle member for an inkjet print cartridge and method of forming the nozzle member are disclosed. A flexible tape having conductive traces formed thereon has formed in it nozzles or orifices by Excimer laser ablation. The resulting nozzle member having orifices and conductive traces may then have mounted on it a substrate containing heating elements associated with each of the orifices. The conductive traces formed on the back surface of the nozzle member are then connected to the electrodes on the substrate and provide energization signals for the heating elements. A barrier layer, which may be a separate layer or formed in the nozzle member itself, includes vaporization chambers, surrounding each orifice, and ink flow channels which provide fluid communication between a ink reservoir and the vaporization chambers. By providing the orifices in the flexible circuit itself, the shortcomings of conventional electroformed orifice plates are overcome. Additionally, the orifices may be formed aligned with the conductive traces on the nozzle member so that alignment of electrodes on a substrate with respect to ends of the conductive traces also aligns the heating elements with the orifices. This integrated nozzle and tab circuit design is superior to the orifice plates for inkjet printheads formed of nickel and fabricated by lithographic electroforming processes as described in U.S. Pat. No. 4,773,971, entitled "Thin Film Mandrel". Such orifice plates for inkjet printheads have several shortcomings such as requiring delicate balancing of parameters such as stress and plating thicknesses, disc diameters, and overplating ratios; inherently limiting the design choices for nozzle shapes and sizes; delamination of the orifice plate from the substrate and corrosion by ink.

In U.S. application Ser. No. 07/864,896, filed Apr. 2, 1992, entitled "Adhesive Seal for an Inkjet Printhead," a procedure for sealing an integrated nozzle and tab circuit to a print cartridge is disclosed. A nozzle member containing an array of orifices has a substrate, having heater elements formed thereon, affixed to a back surface of the nozzle member. Each orifice in the nozzle member is associated with a single heating element formed on the substrate. The back surface of the nozzle member extends beyond the outer edges of the substrate. Ink is supplied from an ink reservoir to the orifices by a fluid channel within a barrier layer between the nozzle member and the substrate. The fluid channel in the barrier layer may receive ink flowing around two or more outer edges of the substrate ("edge feed") or, in another embodiment, may receive ink which flows through a hole in the center of the substrate ("center feed"). In either embodiment, the nozzle member is adhesively sealed with respect to the ink reservoir body by forming an ink seal, circumscribing the substrate, between the back surface of the nozzle member and the body.

This method and structure of providing a seal directly between a nozzle member and an ink reservoir body has many advantages over prior art methods of providing a seal between the back surface of the substrate and the ink reservoir body. One advantage is that such a seal makes an edge ink-feed design possible. Another advantage is that, in an embodiment where the nozzle member has conductive traces formed on its bottom surface for contact to electrodes on the substrate, the adhesive seal acts to encapsulate and protect the traces near the substrate which may come in contact with ink. Additionally, since the sealant is also an adhesive, the nozzle member is directly secured to the ink reservoir body, thus forming a stronger bond between the printhead and the inkjet print cartridge. Further, it is much easier to detect leaks in the sealant, since the sealant line is more readily observable. Another advantage is that it takes less time to cure the adhesive seal, since only a thin nozzle member is between the sealant and the heat source used for curing the sealant.

However, during manufacturing, the headland design of previous print cartridges had several disadvantages, including difficulty in controlling the edge seal to the die or substrate without having adhesive getting into the nozzle and clogging them, or on the other hand, voids of adhesive in the tab bond window. It was also very difficult to control the adhesive bulge through the window caused by excess adhesive, or varying die placement. All of these problems result in extremely high yield losses when manufacturing thermal inkjet print cartridges.

Accordingly, it would be advantageous to have an improved headland design for adhesively attaching a TAB head assembly to a print cartridge.

SUMMARY OF THE INVENTION

This invention provides an improved ink cartridge headland design for providing an ink seal between a print cartridge body and an inkjet printhead. In a preferred embodiment, a nozzle member containing an array of orifices has a substrate, having heater elements formed thereon, affixed to a back surface of the nozzle member. Each orifice in the nozzle member is associated with a single heating element formed on the substrate. The back surface of the nozzle member extends beyond the outer edges of the substrate. Ink is supplied from an ink reservoir to the orifices by a fluid channel within a barrier layer between the nozzle member and the substrate. The fluid channel in the barrier layer may receive ink flowing around two or more outer edges of the substrate or, in another embodiment, may receive ink which flows through a hole in the center of the substrate. In either embodiment, the nozzle member is adhesively sealed with respect to the ink reservoir body by forming an ink seal, circumscribing the substrate, between the back surface of the nozzle member and the headland of the print cartridge body.

This method and structure for a print cartridge headland for providing a seal directly between a nozzle member and an ink reservoir body has many advantages over prior methods of providing a seal between a printhead and the ink reservoir body. One advantage is that such a structure reduces the occurrence of clogged nozzles during the adhesive sealing process. Another advantage is that there is a reduced occurrence of adhesive voids where the adhesive seal acts to encapsulate and protect the traces near the substrate which may come in contact with ink. A further advantage is that it is easier to control adhesive flow and bulges due to varying amounts and placement of adhesive. The above advantages provide reduced yield losses, and thus lower manufacturing costs, when manufacturing inkjet print cartridges.

Other advantages will become apparent after reading the disclosure.

BRIEF DESCRIPTION OF THE DRAWINGS

The present invention can be further understood by reference to the following description and attached drawings which illustrate the preferred embodiment.

Other features and advantages will be apparent from the following detailed description of the preferred embodiment, taken in conjunction with the accompanying drawings, which illustrate, by way of example, the principles of the invention.

DETAILED DESCRIPTION OF THE PREFERRED EMBODIMENTS

Figure 1:
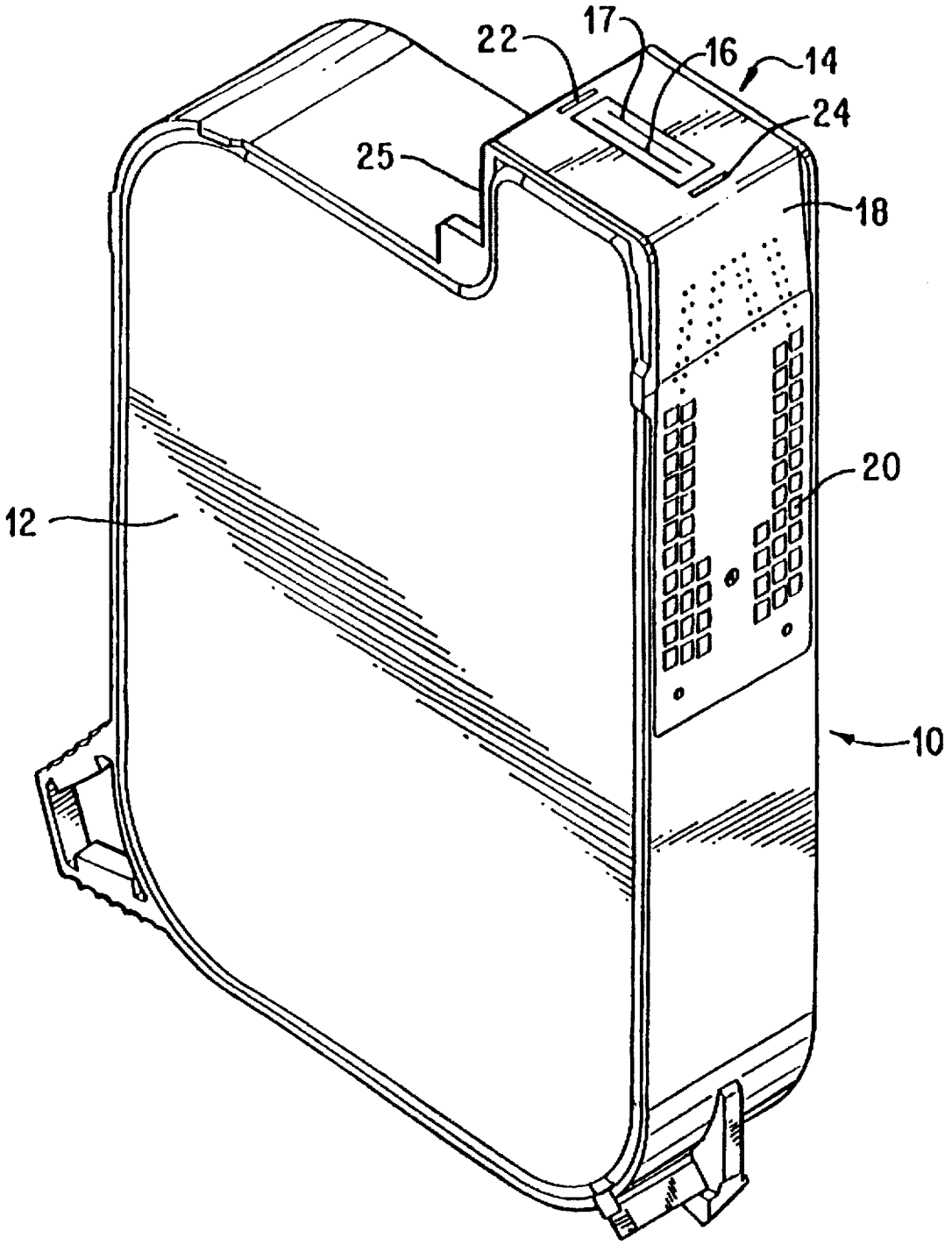
FIG. 1 is a perspective view of an inkjet print cartridge according to one embodiment of the present invention.

Referring to FIG. 1, reference numeral 10 generally indicates an inkjet print cartridge incorporating a printhead according to one embodiment of the present invention simplified for illustrative purposes. The inkjet print cartridge 10 includes an ink reservoir 12 and a printhead 14, where the printhead 14 is formed using Tape Automated Bonding (TAB). The printhead 14 (hereinafter "TAB head assembly 14") includes a nozzle member 16 comprising two parallel columns of offset holes or orifices 17 formed in a flexible polymer flexible circuit 18 by, for example, laser ablation.

A back surface of the flexible circuit 18 includes conductive traces 36 formed thereon using a conventional photolithographic etching and/or plating process. These conductive traces 36 are terminated by large contact pads 20 designed to interconnect with a printer. The print cartridge 10 is designed to be installed in a printer so that the contact pads 20, on the front surface of the flexible circuit 18, contact printer electrodes providing externally generated energization signals to the printhead.

Windows 22 and 24 extend through the flexible circuit 18 and are used to facilitate bonding of the other ends of the conductive traces 36 to electrodes on a silicon substrate containing heater resistors. The windows 22 and 24 are filled with an encapsulant to protect any underlying portion of the traces and substrate.

In the print cartridge 10 of FIG. 1, the flexible circuit 18 is bent over the back edge of the print cartridge "snout" and extends approximately one half the length of the back wall 25 of the snout. This flap portion of the flexible circuit 18 is needed for the routing of conductive traces 36 which are connected to the substrate electrodes through the far end window 22. The contact pads 20 are located on the flexible circuit 18 which is secured to this wall and the conductive traces 36 are routed over the bend and are connected to the substrate electrodes through the windows 22, 24 in the flexible circuit 18.

Figure 2A:
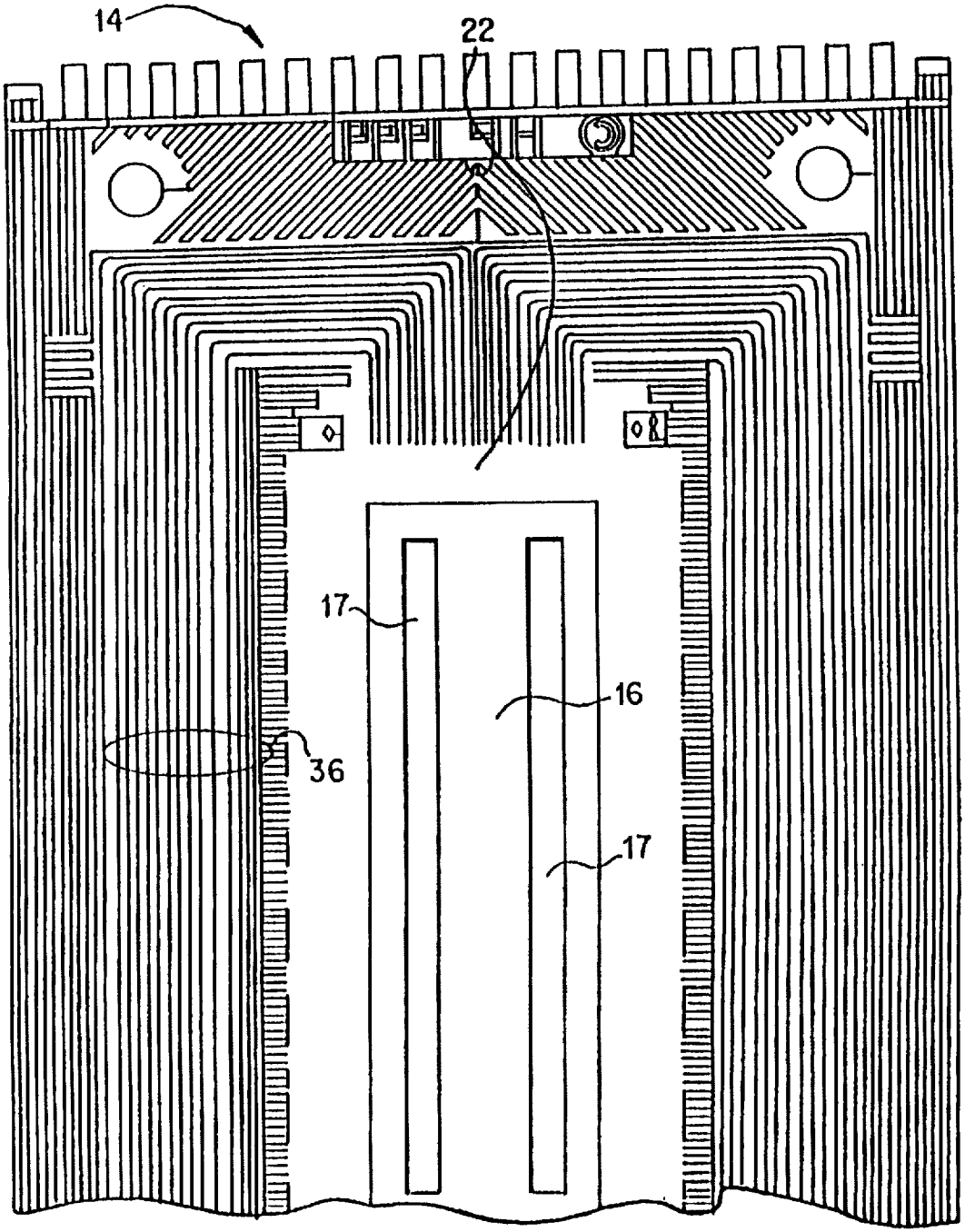
FIG. 2 is a perspective view of the front surface of the Tape Automated Bonding (TAB) printhead assembly (hereinafter "TAB head assembly") removed from the print cartridge of FIG. 1.
Figure 2B:
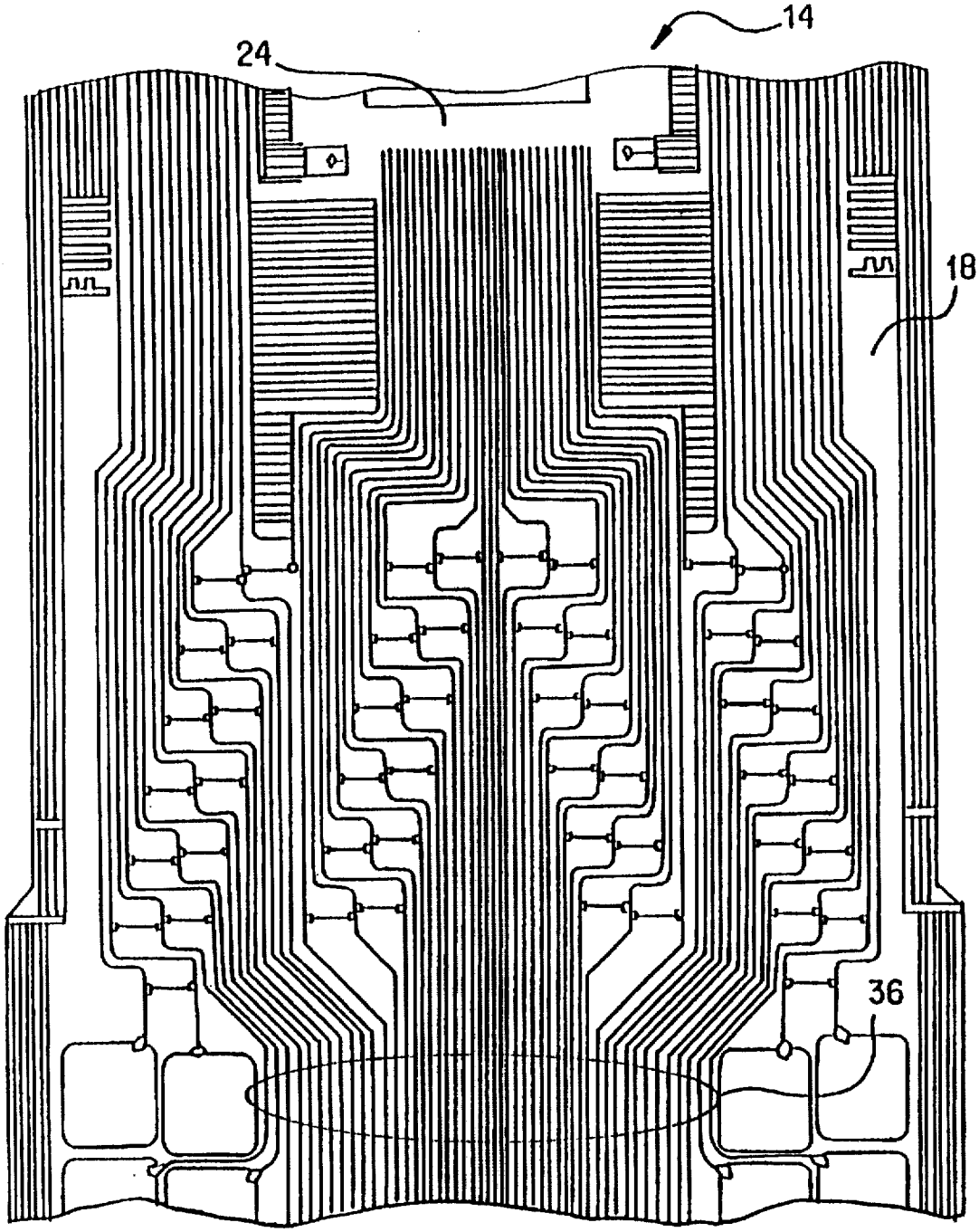
Figure 2C:
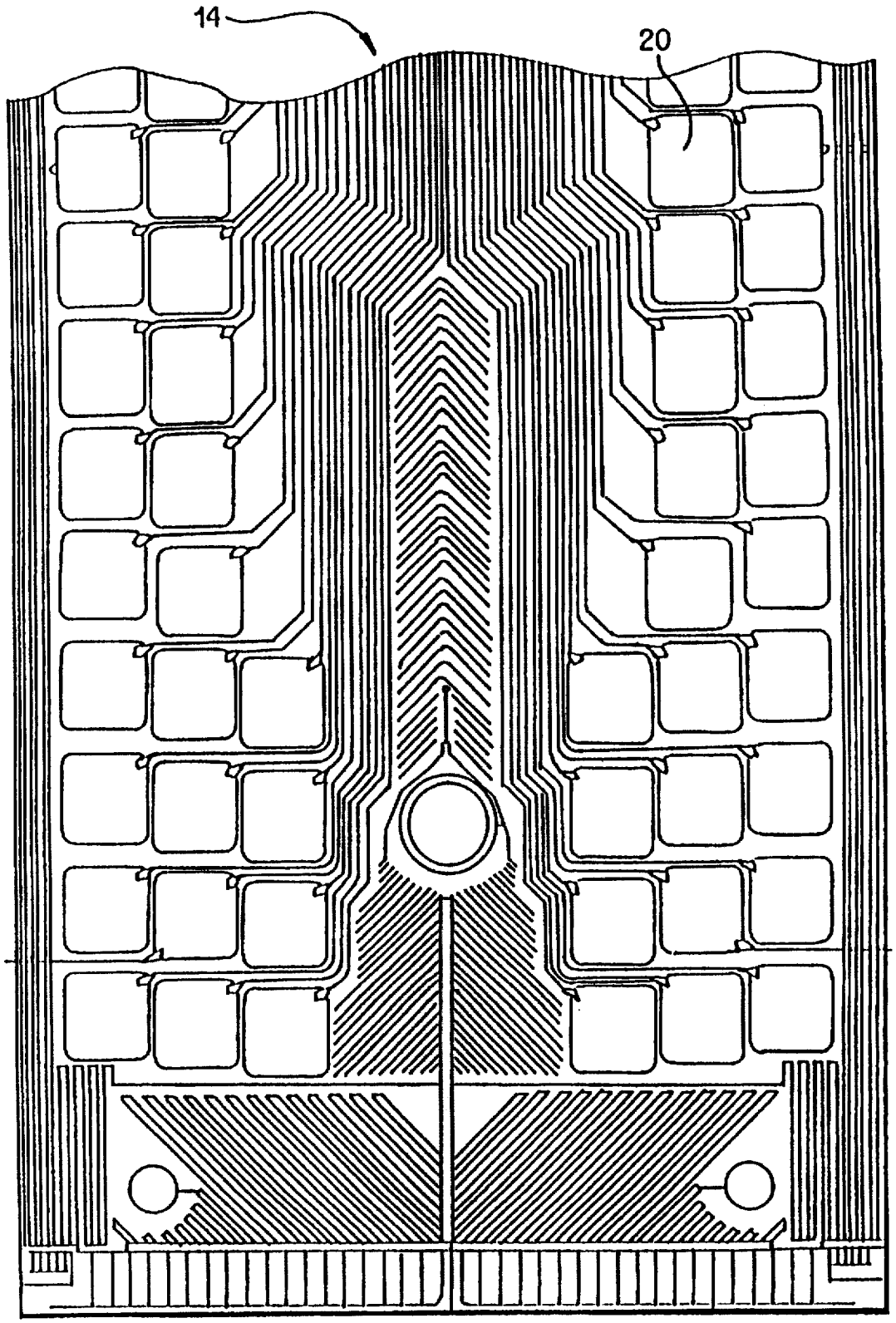

FIG. 2 shows a front view of the TAB head assembly 14 of FIG. 1 removed from the print cartridge 10 and prior to windows 22 and 24 in the TAB head assembly 14 being filled with an encapsulant. TAB head assembly 14 has affixed to the back of the flexible circuit 18 a silicon substrate 28 (not shown) containing a plurality of individually energizable thin film resistors. Each resistor is located generally behind a single orifice 17 and acts as an ohmic heater when selectively energized by one or more pulses applied sequentially or simultaneously to one or more of the contact pads 20.

The orifices 17 and conductive traces 36 may be of any size, number, and pattern, and the various figures are designed to simply and clearly show the features of the invention. The relative dimensions of the various features have been greatly adjusted for the sake of clarity.

Figure 14:
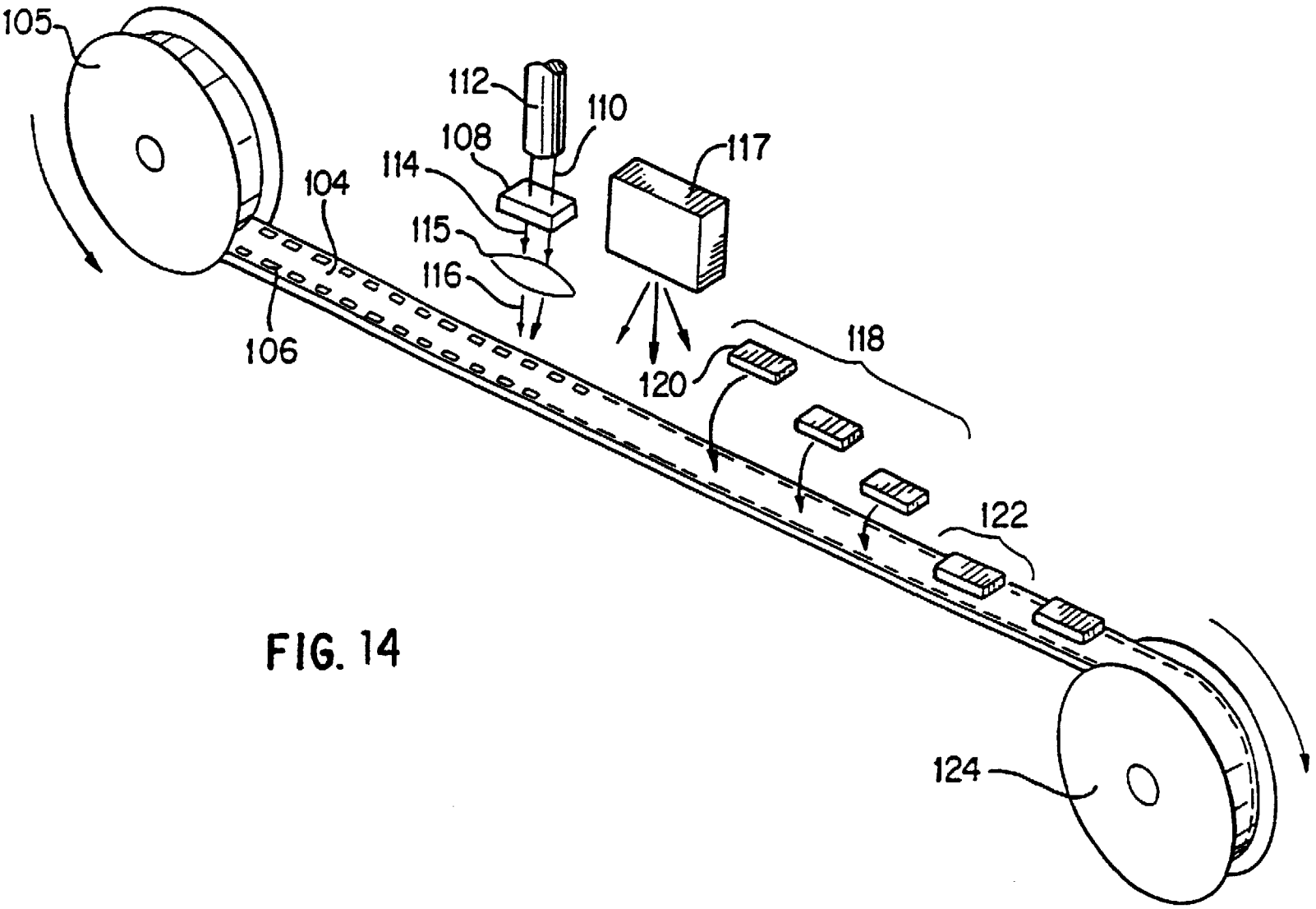
FIG. 14 illustrates one process which may be used to form the preferred TAB head assembly.

The orifice 17 pattern on the flexible circuit 18 shown in FIG. 2 may be formed by a masking process in combination with a laser or other etching means in a step-and-repeat process, which would be readily understood by one of ordinary skilled in the art after reading this disclosure. FIG. 14, to be described in detail later, provides additional details of this process. Further details regarding TAB head assembly 14 and flexible circuit 18 are provided below.

Figure 3:
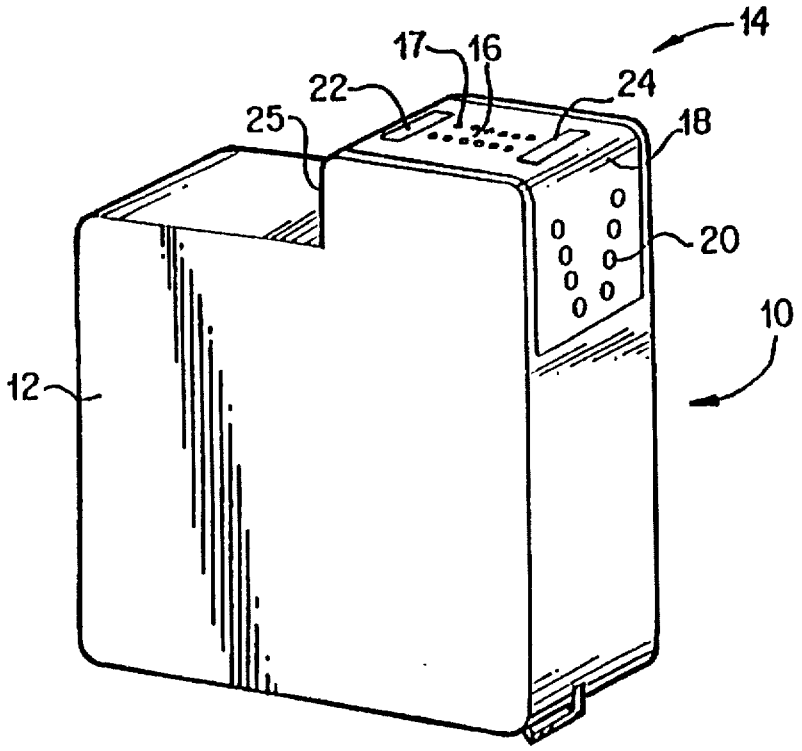
FIG. 3 is a perspective view of an simplified schematic of the inkjet print cartridge of FIG. 1. for illustrative purposes.
Figure 4:
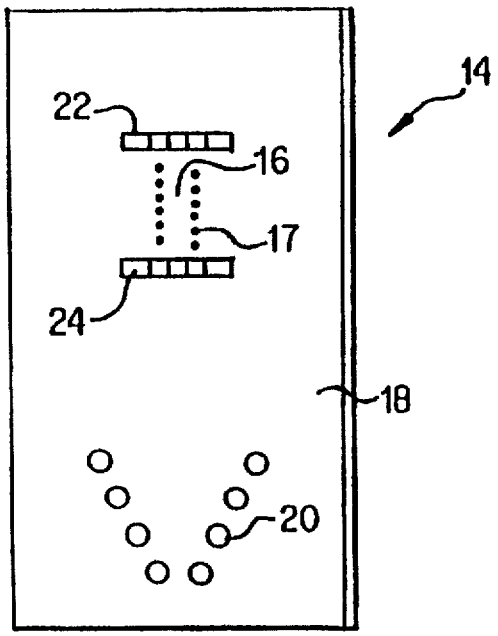
FIG. 4 is a perspective view of the front surface of the Tape Automated Bonding (TAB) printhead assembly (hereinafter "TAB head assembly") removed from the print cartridge of FIG. 3.

FIG. 3 is a perspective view of a simplified schematic of the inkjet print cartridge of FIG. 1 for illustrative purposes. FIG. 4 is a perspective view of the front surface of the Tape Automated Bonding (TAB) printhead assembly (hereinafter "TAB head assembly") removed from the simplified schematic print cartridge of FIG. 3.

Figure 5:
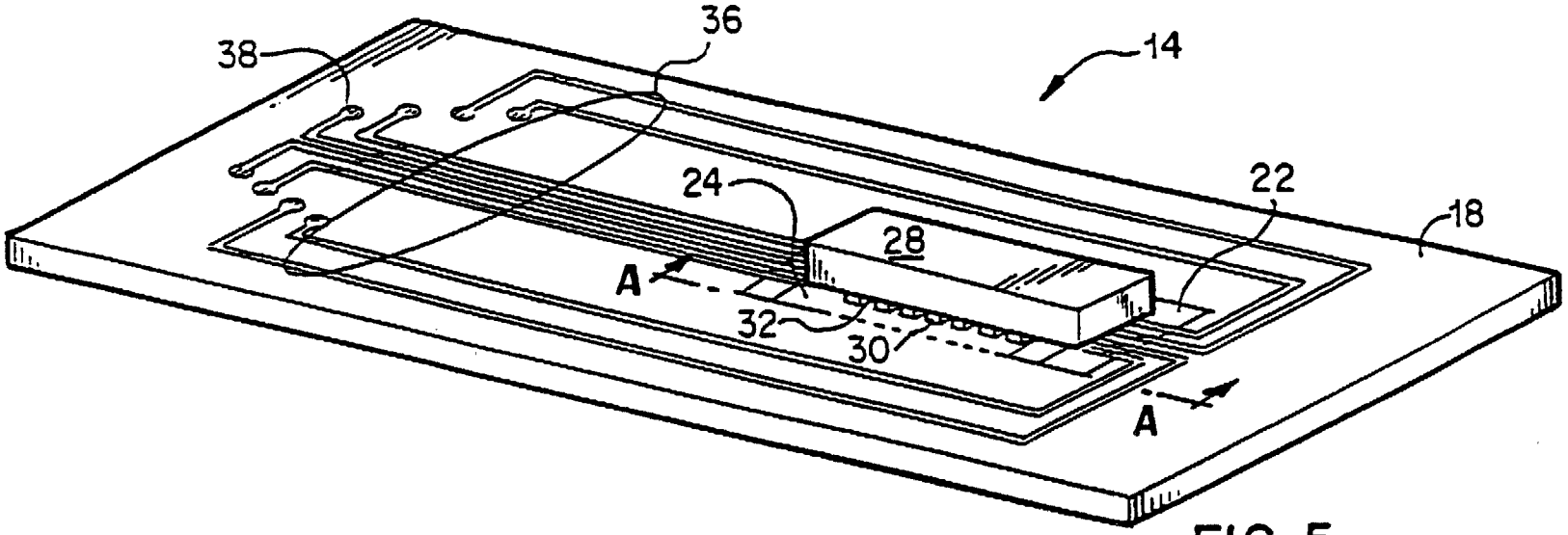
FIG. 5 is a perspective view of the back surface of the TAB head assembly of FIG. 4 with a silicon substrate mounted thereon and the conductive leads attached to the substrate.

FIG. 5 shows the back surface of the TAB head assembly 14 of FIG. 4 showing the silicon die or substrate 28 mounted to the back of the flexible circuit 18 and also showing one edge of the barrier layer 30 formed on the substrate 28 containing ink channels and vaporization chambers. FIG. 7 shows greater detail of this barrier layer 30 and will be discussed later. Shown along the edge of the barrier layer 30 are the entrances to the ink channels 32 which receive ink from the ink reservoir 12. The conductive traces 36 formed on the back of the flexible circuit 18 terminate in contact pads 20 (shown in FIG. 4) on the opposite side of the flexible circuit 18. The windows 22 and 24 allow access to the ends of the conductive traces 36 and the substrate electrodes 40 (shown in FIG. 6) from the other side of the flexible circuit 18 to facilitate bonding.

Figure 6:
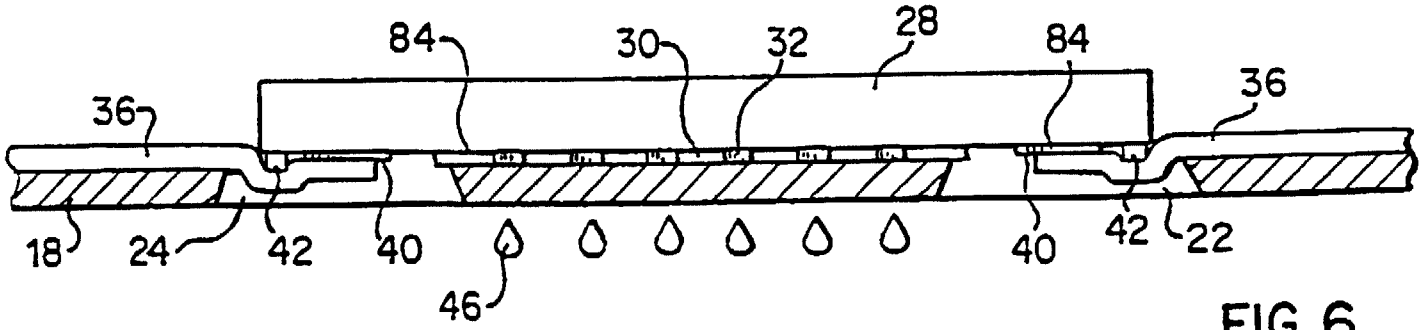
FIG. 6 is a side elevational view in cross-section taken along line A—A in FIG. 5 illustrating the attachment of conductive leads to electrodes on the silicon substrate.
Figure 7:
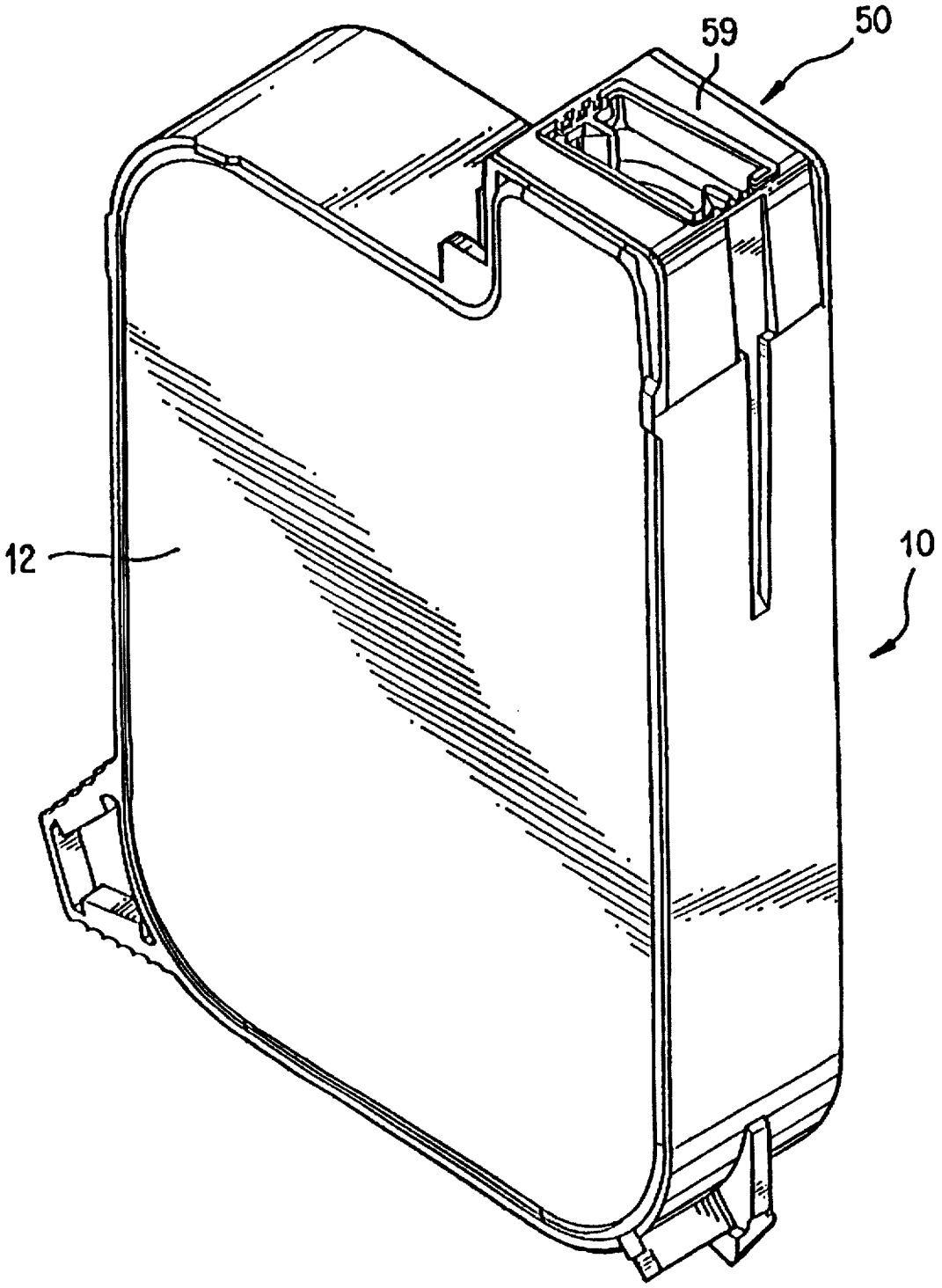
FIG. 7 is a perspective view of the inkjet print cartridge of FIG. 1 with the TAB head assembly removed.

FIG. 6 shows a side view cross-section taken along line A—A in FIG. 5 illustrating the connection of the ends of the conductive traces 36 to the electrodes 40 formed on the substrate 28. As seen in FIG. 6, a potion 42 of the barrier layer 30 is used to insulate the ends of the conductive traces 36 from the substrate 28. Also shown in FIG. 6 is a side view of the flexible circuit 18, the barrier layer 30, the windows 22 and 24, and the entrances of the various ink channels 32. Droplets of ink 46 are shown being ejected from orifice holes associated with each of the ink channels 32.

Figure 8:
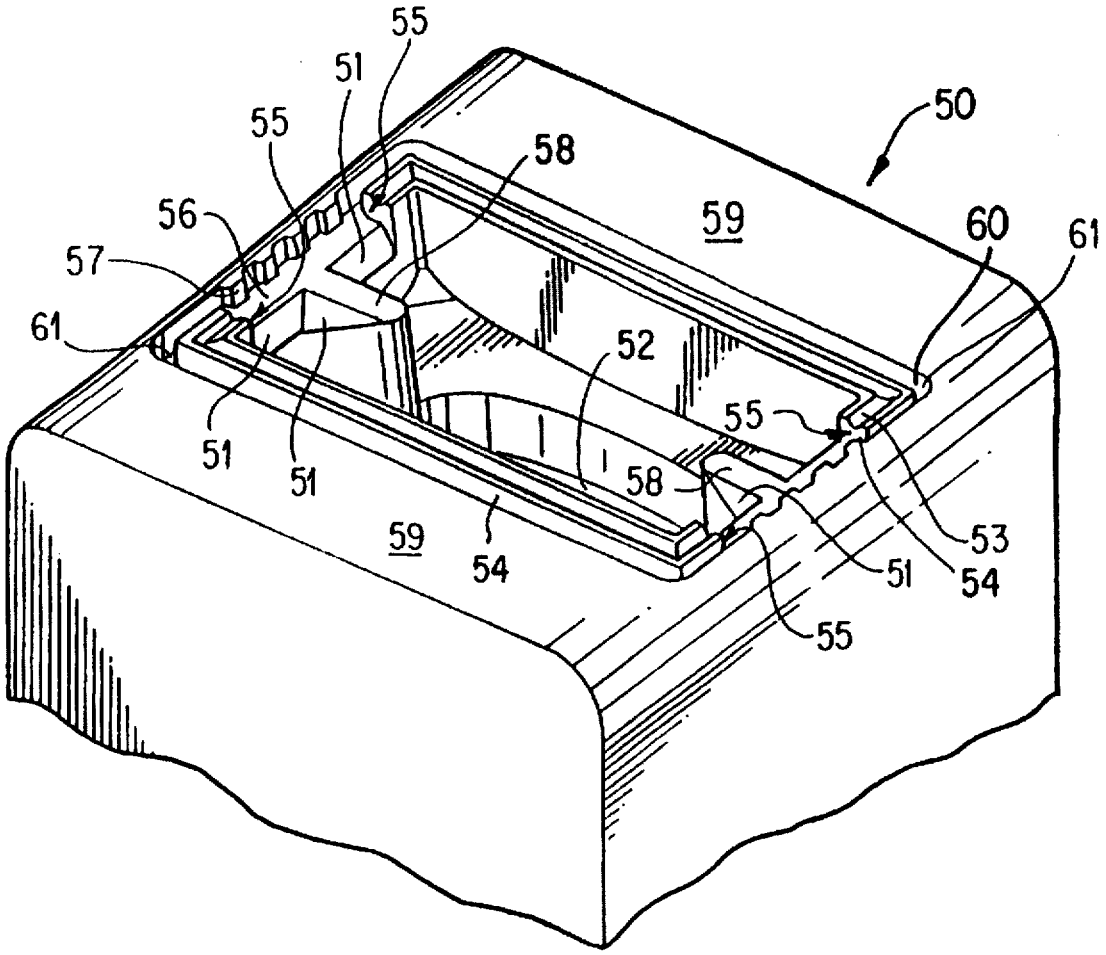
FIG. 8 is a perspective view of the headland area of the inkjet print cartridge of FIG. 7.
Figure 9:
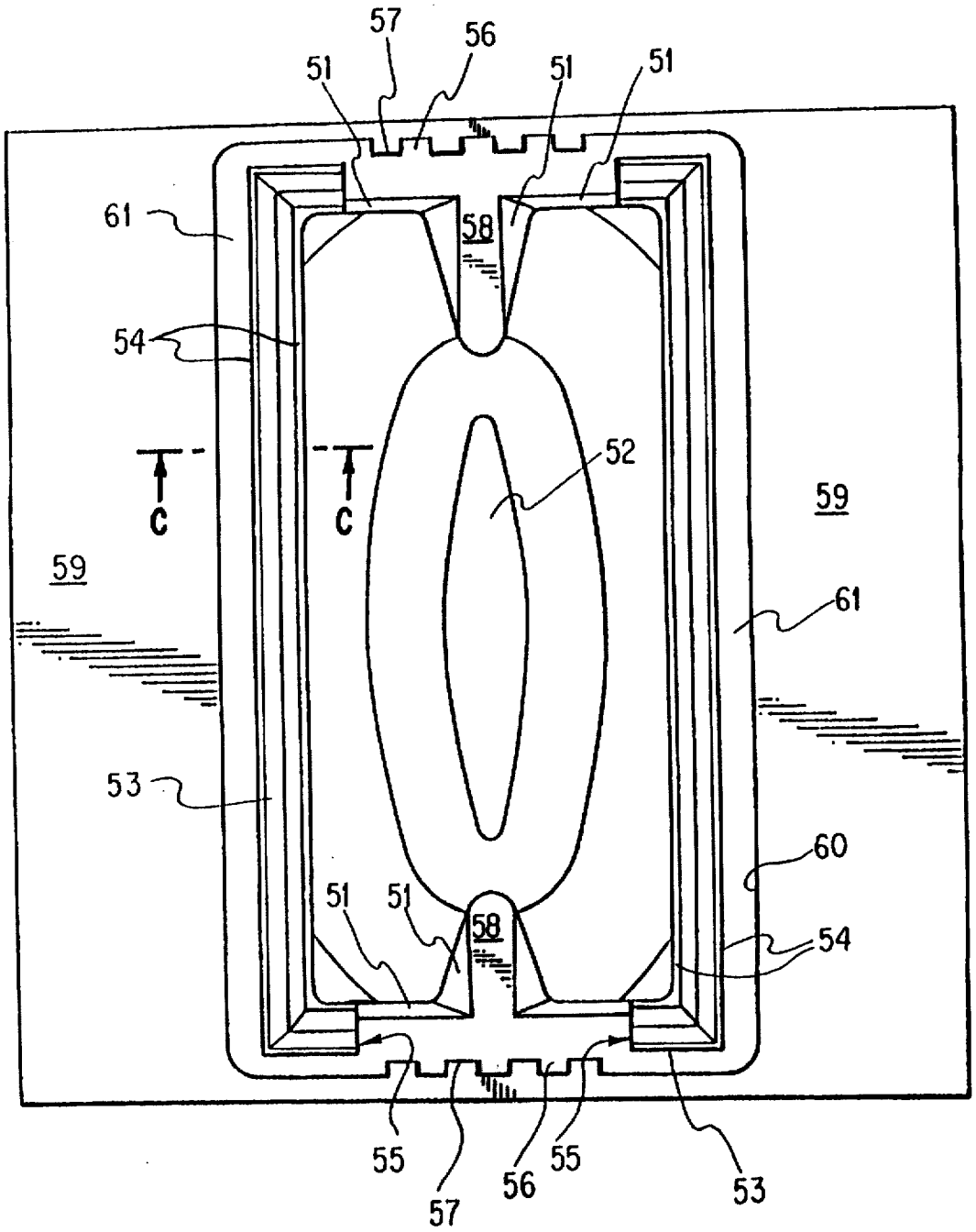
FIG. 9 is a top plan view of the headland area of the inkjet print cartridge of FIG. 7.

FIG. 7 shows the print cartridge 10 of FIG. 1 with the TAB head assembly 14 removed to reveal the headland design 50 used in providing a seal between the TAB head assembly 14 and the printhead body. FIG. 8 shows the headland area 50 in enlarged perspective view. FIG. 9 shows the headland area 50 in an enlarged top plan view. The headland area 50 characteristics are exaggerated for clarity. Shown in FIGS. 8 and 9 is a central slot 52 in the print cartridge 10 for allowing ink from the ink reservoir 12 to flow to the back surface of the TAB head assembly 14.

Figure 8A:
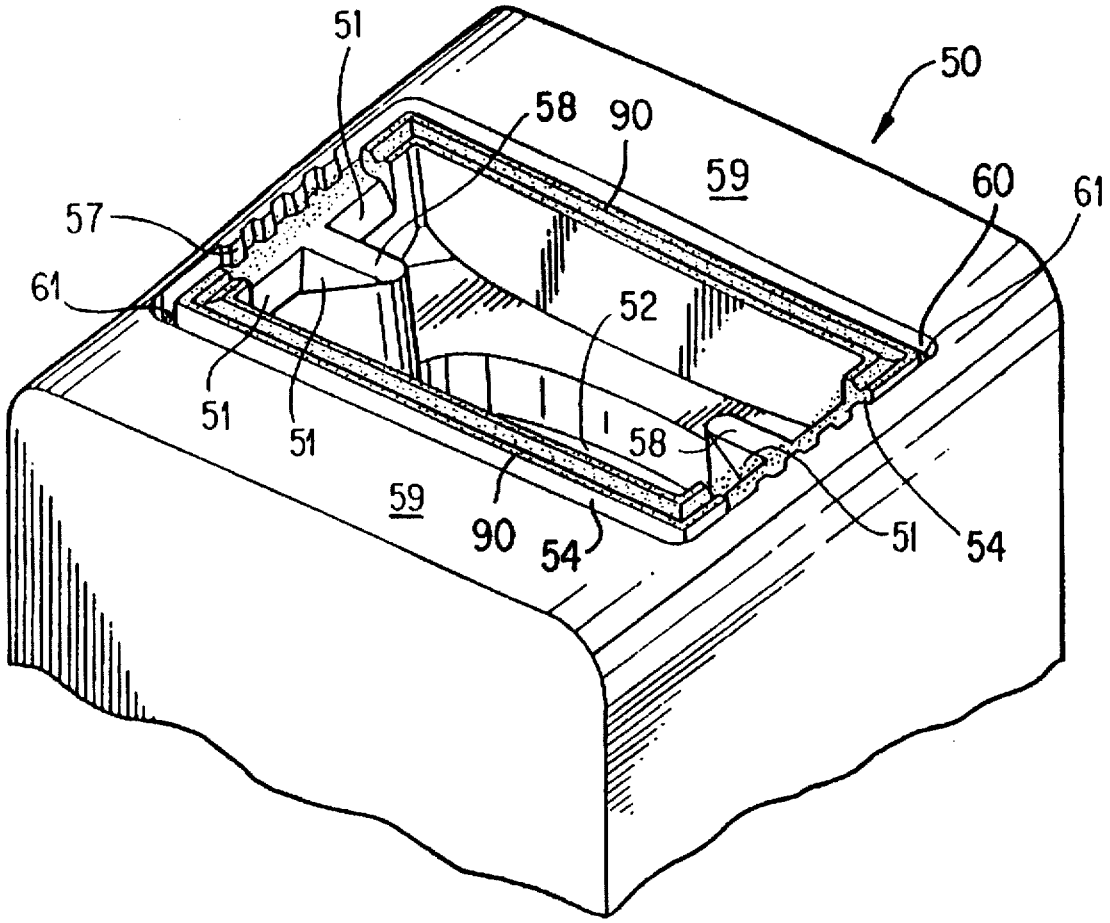
FIG. 8A is a perspective view of the headland area of the inkjet print cartridge showing the location of the adhesive bead.
Figure 9A:
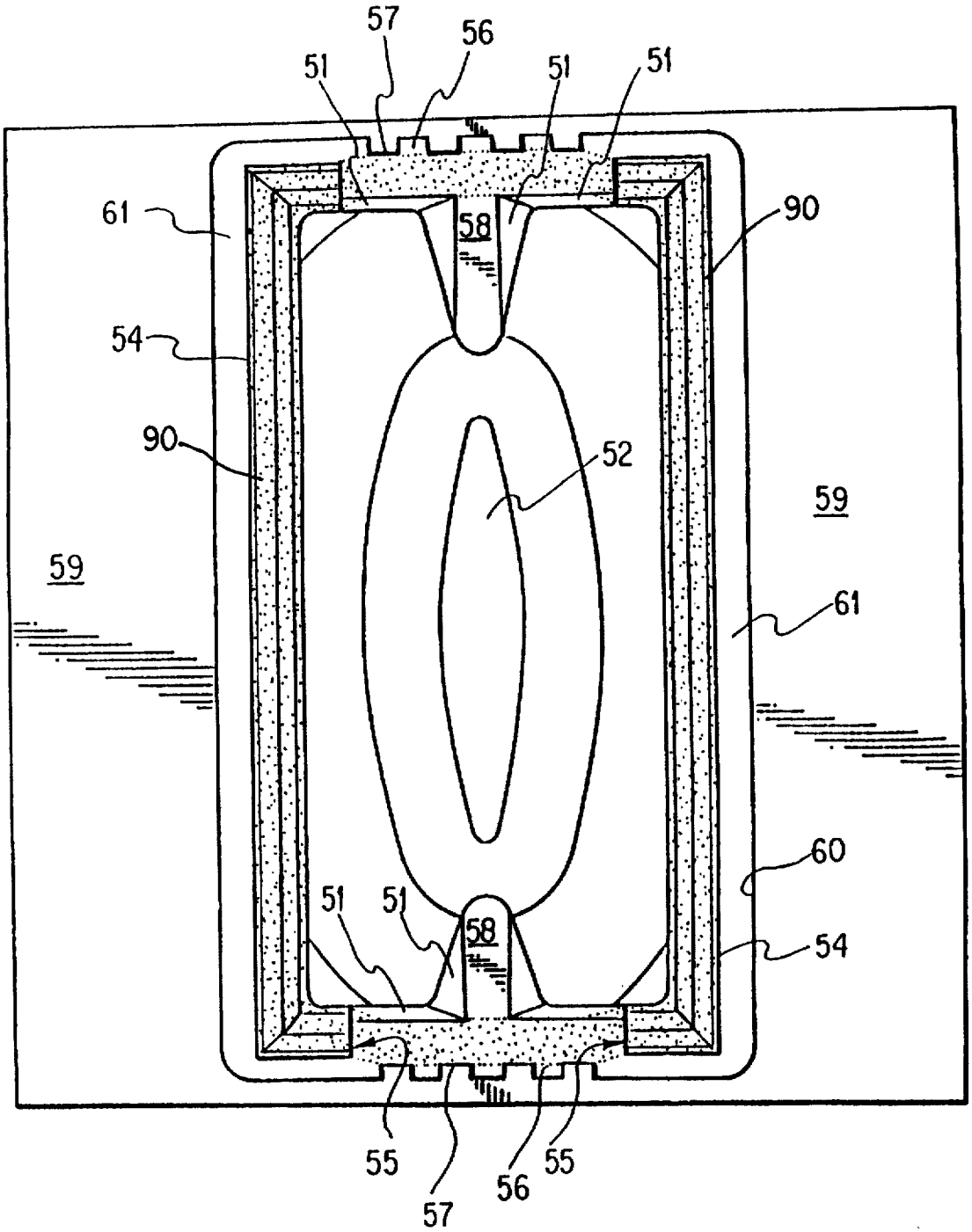
FIG. 9A is a top plan view of the headland area showing the location of the adhesive bead prior to placing the TAB head assembly on the headland area.
Figure 9B:
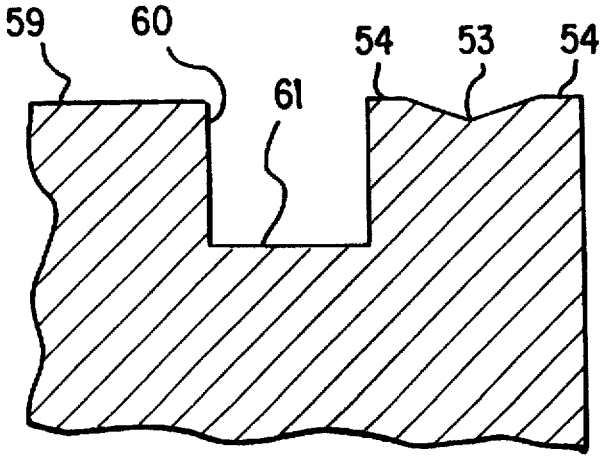
FIG. 9B is a side elevational view in cross-section taken along line C—C in FIG. 9 illustrating the configuration of the inner walls and gutter of the headland design.

The frame geometry, or headland design, 50 formed on the snout of the print cartridge 10 is configured so that a bead of epoxy adhesive 90 dispensed along adhesive "V" groove 53 on the inner raised wall 54 and across the wall openings 55 in the inner raised wall and adjacent to and suspended off of adhesive ridges 57 (so as to circumscribe the substrate when the TAB head assembly 14 is in place) will form an ink seal between headland area 50 of the body of the print cartridge 10 and the back of the TAB head assembly 14 when the TAB head assembly 14 is pressed into place against the headland 50. FIGS. 8A and 9A show the location of the dispensed adhesive. FIG. 9B shows the inner raised wall 54 and gutter 61 in cross-sectional view along sectional line C—C in FIG. 9. Other adhesives which may be used include hot-melt, silicone, UV curable adhesive, and mixtures thereof. Further, a patterned adhesive film may be positioned on the headland 50, as opposed to dispensing a bead of adhesive.

Figure 10:
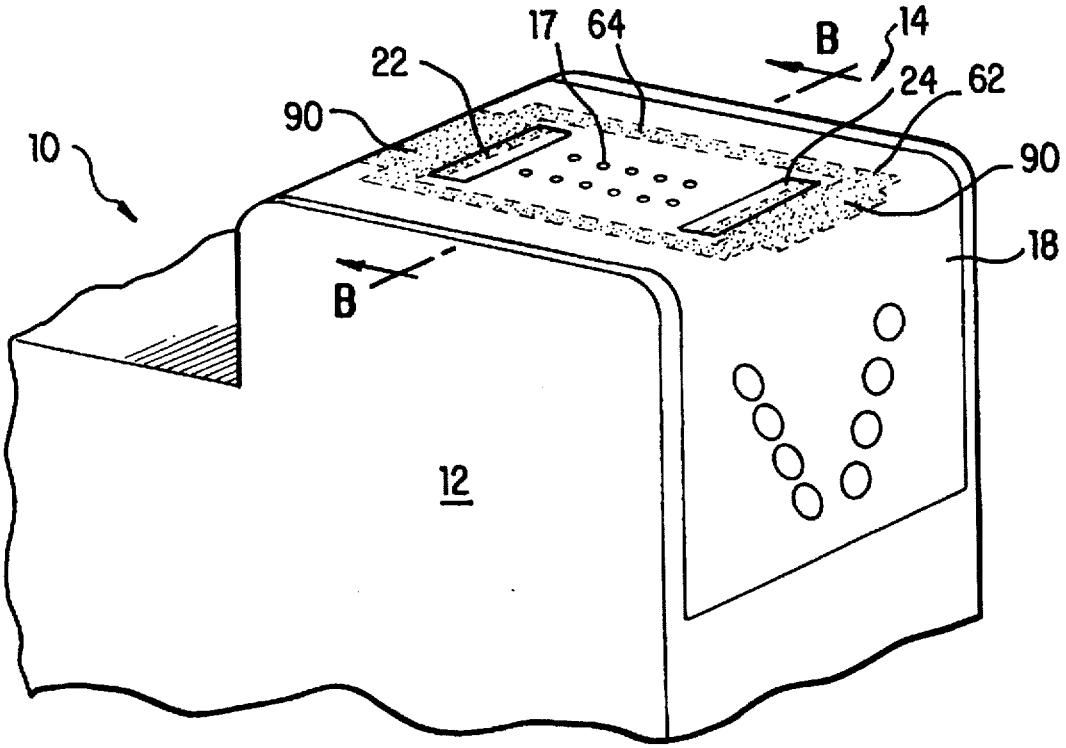
FIG. 10 is a perspective schematic view of a portion of the inkjet print cartridge of FIG. 3 illustrating the configuration of a seal which is formed between the ink cartridge body and the TAB head assembly.
Figure 13:
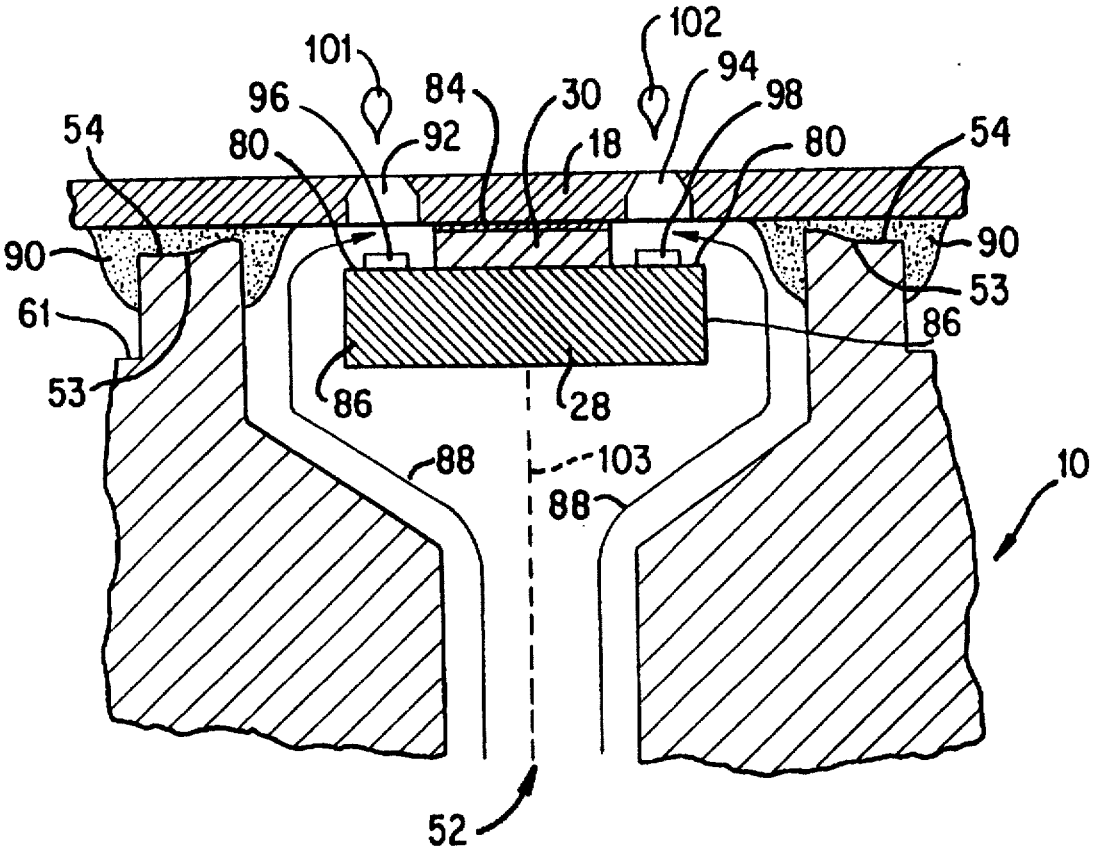
FIG. 13 is a schematic cross-sectional view taken along line B—B of FIG. 10 showing the adhesive seal between the TAB head assembly and the print cartridge as well as the ink flow path around the edges of the substrate.

When the TAB head assembly 14 of FIG. 5 is properly positioned and pressed down on the headland design 50 shown in FIGS. 8 and 9 after the adhesive is dispensed (as shown in FIGS. 8A and 9A), the two short ends of the substrate 28 will be supported by the substrate support surface 58. Additional details showing the location of adhesive 90 are shown in FIGS. 10 and 13. The configuration of the headland design 50 is such that, when the substrate 28 is supported by the substrate support surface 58, the back surface of the flexible circuit 18 will be slightly above the top of the inner raised walls 54 and approximately flush with the flat top surface 59 of the print cartridge 10. As the TAB head assembly 14 is pressed down onto the headland 50, the adhesive is squished down. From the top of the inner raised walls 54, the adhesive overspills into the gutter 61 between the inner raised walls 54 and the outer raised wall 60. From the wall openings 55 in the inner raised wall, the adhesive squishes upwardly through window 22, 24, squishes inwardly in the direction of spill trough 51 and squishes outwardly toward the outer raised wall 60, which blocks further outward displacement of the adhesive. The outward displacement of the adhesive not only serves as an ink seal, but encapsulates the conductive traces in the vicinity of the windows 22, 24 from underneath to protect the conductive traces from ink.

The headland design 50 of print cartridge 10 utilizes specific unique features to address the difficulty in controlling the adhesive seal of the headland to the TAB head assembly 14. To eliminate nozzle clogs and adhesive voids in the windows 22, 24 tab bond window, a downwardly beveled edge or angled spill trough 51 is provided. The purpose of this spill trough 51 is to allow the excess adhesive to spill downwards onto spill trough 51 if too much adhesive is applied. The spill trough 51 channels the excess adhesive away from the nozzles 17 and thereby prevents nozzle clogs from forming. This allows the dispensing of a greater variance in adhesive volumes without impairing the functionality of the print cartridge 10. This results in much lower yield losses, greatly reducing the overall manufacturing cost of the print cartridge 10.

To control a bulge of adhesive through the windows 22, 24 in the TAB head assembly 14 caused by excess adhesive, or varying substrate placement, the structural adhesive is suspended by the protruding edges of the adhesive ridges 57. When the TAB head assembly 14 is placed on the headland 50, the adhesive squishes up and partially fills out the back of the windows 22, 24 of the TAB head assembly 14 and then begins to fill up the available area 56 between the adhesive ridges 57. Essentially, no adhesive will squish through the windows 22, 24 until the available area 56 between the adhesive ridges 57 are all filled with adhesive. Therefore, when a larger volume of adhesive is applied, the open areas 56 between the adhesive ridges 57 begins to fill in without a great increase in adhesive bulge through the windows 22, 24.

FIG. 10 shows a portion of the completed print cartridge 10 of FIG. 3, illustrating in schematic form without headland details, by cross-hatching, the location of the underlying adhesive 90 which forms the adhesive seal between the TAB head assembly 14 and the headland area 50 of the print cartridge 10. In FIG. 10 the adhesive is located generally between the dashed lines surrounding the array of orifices 17, where the outer dashed line 62 is slightly within the boundaries of the outer raised wall 60 in FIG. 8, and the inner dashed line 64 is slightly within the boundaries of the inner raised walls 54 in FIG. 8. The adhesive is also shown being squished through the wall openings 55 in the inner raised wall (FIGS. 8 and 9) to encapsulate the traces leading to electrodes on the substrate. The adhesive also squishes up through approximately one-half of the windows 22, 24 and flush with the top surface of the windows. A cross-section of this seal taken along line B—B in FIG. 10 is also shown in FIG. 13, to be discussed later.

This seal formed by the adhesive 90 circumscribing the substrate 28 allows ink to flow from slot 52 and around the sides of the substrate to the vaporization chambers formed in the barrier layer 30, but will prevent ink from seeping out from under the TAB head assembly 14. Thus, this adhesive seal 90 provides a strong mechanical coupling of the TAB head assembly 14 to the print cartridge 10, provides a fluidic seal, and provides trace encapsulation. The adhesive seal is also easier to cure than prior art seals, and it is much easier to detect leaks between the print cartridge body and the printhead, since the sealant line is readily observable. Further details on adhesive seal 90 are shown in FIG. 13.

Figure 11:
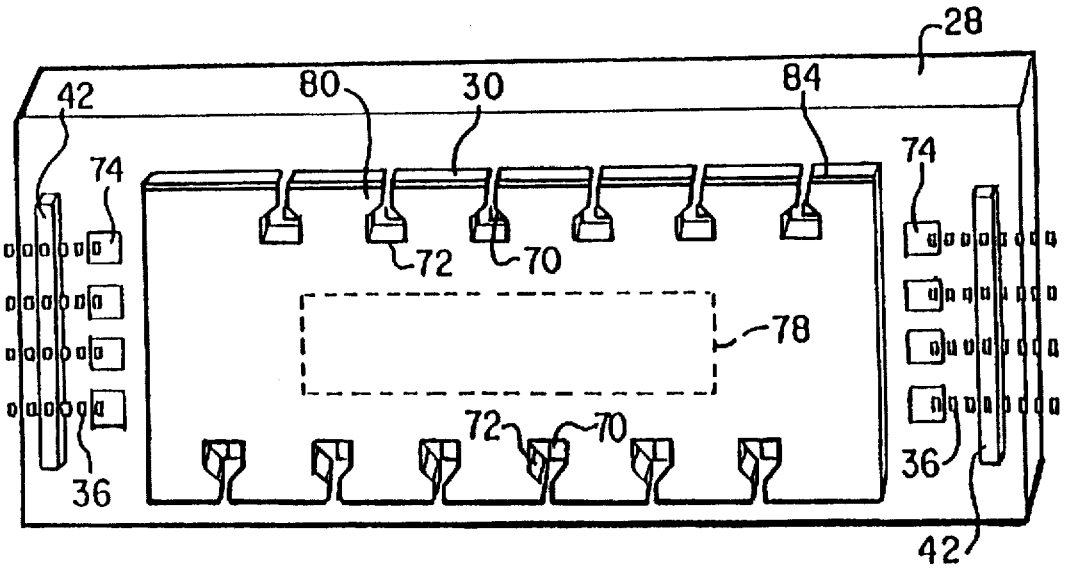
FIG. 11 is a top perspective view of a substrate structure containing heater resistors, ink channels, and vaporization chambers, which is mounted on the back of the TAB head assembly of FIG. 4.

FIG. 11 is a front perspective view of the silicon substrate 28 which is affixed to the back of the flexible circuit 18 in FIG. 5 to form the TAB head assembly 14. Silicon substrate 28 has formed on it, using conventional photolithographic techniques, two rows or columns of thin film resistors 70, shown in FIG. 11 exposed through the vaporization chambers 72 formed in the barrier layer 30.

In one embodiment, the substrate 28 is approximately one-half inch long and contains 300 heater resistors 70, thus enabling a resolution of 600 dots per inch. Heater resistors 70 may instead be any other type of ink ejection element, such as a piezoelectric pump-type element or any other conventional element. Thus, element 70 in all the various figures may be considered to be piezoelectric elements in an alternative embodiment without affecting the operation of the printhead. Also formed on the substrate 28 are electrodes 74 for connection to the conductive traces 36 (shown by dashed lines) formed on the back of the flexible circuit 18.

A demultiplexer 78, shown by a dashed outline in FIG. 11, is also formed on the substrate 28 for demultiplexing the incoming multiplexed signals applied to the electrodes 74 and distributing the signals to the various thin film resistors 70. The demultiplexer 78 enables the use of much fewer electrodes 74 than thin film resistors 70. Having fewer electrodes allows all connections to the substrate to be made from the short end portions of the substrate, as shown in FIG. 4, so that these connections will not interfere with the ink flow around the long sides of the substrate. The demultiplexer 78 may be any decoder for decoding encoded signals applied to the electrodes 74. The demultiplexer has input leads (not shown for simplicity) connected to the electrodes 74 and has output leads (not shown) connected to the various resistors 70. The demultiplexer 78 circuity is discussed in further detail below.

Also formed on the surface of the substrate 28 using conventional photolithographic techniques is the barrier layer 30, which may be a layer of photoresist or some other polymer, in which is formed the vaporization chambers 72 and ink channels 80. A portion 42 of the barrier layer 30 insulates the conductive traces 36 from the underlying substrate 28, as previously discussed with respect to FIG. 4.

In order to adhesively affix the top surface of the barrier layer 30 to the back surface of the flexible circuit 18 shown in FIG. 5, a thin adhesive layer 84 (not shown), such as an uncured layer of poly-isoprene photoresist, is applied to the top surface of the barrier layer 30. A separate adhesive layer may not be necessary if the top of the barrier layer 30 can be otherwise made adhesive. The resulting substrate structure is then positioned with respect to the back surface of the flexible circuit 18 so as to align the resistors 70 with the orifices formed in the flexible circuit 18. This alignment step also inherently aligns the electrodes 74 with the ends of the conductive traces 36. The traces 36 are then bonded to the electrodes 74. This alignment and bonding process is described in more detail later with respect to FIG. 14. The aligned and bonded substrate/flexible circuit structure is then heated while applying pressure to cure the adhesive layer 84 and firmly affix the substrate structure to the back surface of the flexible circuit 18.

Figure 12:
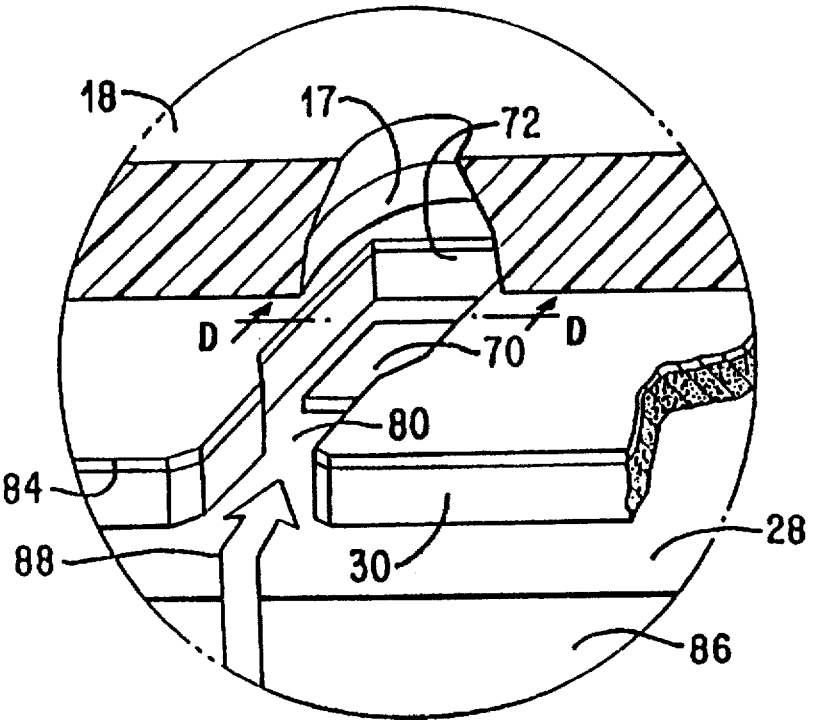
FIG. 12 is a top perspective view, partially cut away, of a portion of the TAB head assembly showing the relationship of an orifice with respect to a vaporization chamber, a heater resistor, and an edge of the substrate.

FIG. 12 is an enlarged view of a single vaporization chamber 72, thin film resistor 70, and frustum shaped orifice 17 after the substrate structure of FIG. 11 is secured to the back of the flexible circuit 18 via the thin adhesive layer 84. A side edge of the substrate 28 is shown as edge 86. In operation, ink flows from the ink reservoir 12 around the side edge 86 of the substrate 28, and into the ink channel 80 and associated vaporization chamber 72, as shown by the arrow 88. Upon energization of the thin film resistor 70, a thin layer of the adjacent ink is superheated, causing explosive vaporization and, consequently, causing a droplet of ink to be ejected through the orifice 17. The vaporization chamber 72 is then refilled by capillary action.

In a preferred embodiment, the barrier layer 30 is approximately 1 mils thick, the substrate 28 is approximately 20 mils thick, and the flexible circuit 18 is approximately 2 mils thick.

Shown in FIG. 13 is a side elevational view cross-section taken along line B—B in FIG. 10 showing a portion of the adhesive seal 90, applied to the inner raised wall 54 and wall openings 56, surrounding the substrate 28 and showing the substrate 28 being adhesively secured to a central portion of the flexible circuit 18 by the thin adhesive layer 84 on the top surface of the barrier layer 30 containing the ink channels and vaporization chambers 92 and 94. A portion of the body of the printhead cartridge 10, including raised walls 54 shown in FIGS. 7 and 8, is also shown.

FIG. 13 also illustrates how ink 88 from the ink reservoir 12 flows through the central slot 52 formed in the print cartridge 10 and flows around the edges 86 of the substrate 28 through ink channels 80 into the vaporization chambers 92 and 94. Thin film resistors 96 and 98 are shown within the vaporization chambers 92 and 94, respectively. When the resistors 96 and 98 are energized, the ink within the vaporization chambers 92 and 94 are ejected, as illustrated by the emitted drops of ink 101 and 102.

The edge feed feature, where ink flows around the edges 86 of the substrate 28 and directly into ink channels 80, has a number of advantages over previous center feed printhead designs which form an elongated central hole or slot running lengthwise in the substrate to allow ink to flow into a central manifold and ultimately to the entrances of ink channels. One advantage is that the substrate or die 28 width can be made narrower, due to the absence of the elongated central hole or slot in the substrate. Not only can the substrate be made narrower, but the length of the edge feed substrate can be shorter, for the same number of nozzles, than the center feed substrate due to the substrate structure now being less prone to cracking or breaking without the central ink feed hole. This shortening of the substrate 28 enables a shorter headland 50 in FIG. 8 and, hence, a shorter print cartridge snout. This is important when the print cartridge 10 is installed in a printer which uses one or more pinch rollers below the snout's transport path across the paper to press the paper against the rotatable platen and which also uses one or more rollers (also called star wheels) above the transport path to maintain the paper contact around the platen. With a shorter print cartridge snout, the star wheels can be located closer to the pinch rollers to ensure better paper/roller contact along the transport path of the print cartridge snout. Additionally, by making the substrate smaller, more substrates can be formed per wafer, thus lowering the material cost per substrate.

Other advantages of the edge feed feature are that manufacturing time is saved by not having to etch a slot in the substrate, and the substrate is less prone to breakage during handling. Further, the substrate is able to dissipate more heat, since the ink flowing across the back of the substrate and around the edges of the substrate acts to draw heat away from the back of the substrate.

There are also a number of performance advantages to the edge feed design. Be eliminating the manifold as well as the slot in the substrate, the ink is able to flow more rapidly into the vaporization chambers, since there is less restriction on the ink flow. This more rapid ink flow improves the frequency response of the printhead, allowing higher printing rates from a given number of orifices. Further, the more rapid ink flow reduces crosstalk between nearby vaporization chambers caused by variations in ink flow as the heater elements in the vaporization chambers are fired.

FIG. 14 illustrates one method for forming the preferred embodiment of the TAB head assembly 14. The starting material is a Kapton or Upilex type polymer tape 104, although the tape 104 can be any suitable polymer film which is acceptable for use in the below-described procedure. Some such films may comprise teflon, polyamide, polymethylmethacrylate, polycarbonate, polyester, polyamide polyethylene-terephthalate or mixtures thereof.

The tape 104 is typically provided in long strips on a reel 105. Sprocket holes 106 along the sides of the tape 104 are used to accurately and securely transport the tape 104. Alternately, the sprocket holes 106 may be omitted and the tape may be transported with other types of fixtures.

In the preferred embodiment, the tape 104 is already provided with conductive copper traces 36, such as shown in FIGS. 2, 4 and 5, formed thereon using conventional metal deposition and photolithographic processes. The particular pattern of conductive traces depends on the manner in which it is desired to distribute electrical signals to the electrodes formed on silicon dies, which are subsequently mounted on the tape 104.

In the preferred process, the tape 104 is transported to a laser processing chamber and laser-ablated in a pattern defined by one or more masks 108 using laser radiation 110, such as that generated by an Excimer laser 112 of the $F_2$, ArF, KrCl, KrF, or XeCl type. The masked laser radiation is designated by arrows 114.

In a preferred embodiment, such masks 108 define all of the ablated features for an extended area of the tape 104, for example encompassing multiple orifices in the case of an orifice pattern mask 108, and multiple vaporization chambers in the case of a vaporization chamber pattern mask 108. Alternatively, patterns such as the orifice pattern, the vaporization chamber pattern, or other patterns may be placed side by side on a common mask substrate which is substantially larger than the laser beam. Then such patterns may be moved sequentially into the beam. The masking material used in such masks will preferably be highly reflecting at the laser wavelength, consisting of, for example, a multilayer dielectric or a metal such as aluminum.

The orifice pattern defined by the one or more masks 108 may be that generally shown in FIG. 21. Multiple masks 108 may be used to form a stepped orifice taper as shown in FIG. 12.

In one embodiment, a separate mask 108 defines the pattern of windows 22 and 24 shown in FIGS. 1 and 2; however, in the preferred embodiment, the windows 22 and 24 are formed using conventional photolithographic methods prior to the tape 104 being subjected to the processes shown in FIG. 14.

In an alternative embodiment of a nozzle member, where the nozzle member also includes vaporization chambers, one or more masks 108 would be used to form the orifices and another mask 108 and laser energy level (and/or number of laser shots) would be used to define the vaporization chambers, ink channels, and manifolds which are formed through a portion of the thickness of the tape 104.

The laser system for this process generally includes beam delivery optics, alignment optics, a high precision and high speed mask shuffle system, and a processing chamber including a mechanism for handling and positioning the tape 104. In the preferred embodiment, the laser system uses a projection mask configuration wherein a precision lens 115 interposed between the mask 108 and the tape 104 projects the Excimer laser light onto the tape 104 in the image of the pattern defined on the mask 108.

The masked laser radiation exiting from lens 115 is represented by arrows 116. Such a projection mask configuration is advantageous for high precision orifice dimensions, because the mask is physically remote from the nozzle member. Soot is naturally formed and ejected in the ablation process, traveling distances of about one centimeter from the nozzle member being ablated. If the mask were in contact with the nozzle member, or in proximity to it, soot buildup on the mask would tend to distort ablated features and reduce their dimensional accuracy. In the preferred embodiment, the projection lens is more than two centimeters from the nozzle member being ablated, thereby avoiding the buildup of any soot on it or on the mask.

Ablation is well known to produce features with tapered walls, tapered so that the diameter of an orifice is larger at the surface onto which the laser is incident, and smaller at the exit surface. The taper angle varies significantly with variations in the optical energy density incident on the nozzle member for energy densities less than about two joules per square centimeter. If the energy density were uncontrolled, the orifices produced would vary significantly in taper angle, resulting in substantial variations in exit orifice diameter. Such variations would produce deleterious variations in ejected ink drop volume and velocity, reducing print quality. In the preferred embodiment, the optical energy of the ablating laser beam is precisely monitored and controlled to achieve a consistent taper angle, and thereby a reproducible exit diameter. In addition to the print quality benefits resulting from the constant orifice exit diameter, a taper is beneficial to the operation of the orifices, since the taper acts to increase the discharge speed and provide a more focused ejection of ink, as well as provide other advantages. The taper may be in the range of 5 to 15 degrees relative to the axis of the orifice. The preferred embodiment process described herein allows rapid and precise fabrication without a need to rock the laser beam relative to the nozzle member. It produces accurate exit diameters even though the laser beam is incident on the entrance surface rather than the exit surface of the nozzle member.

After the step of laser-ablation, the polymer tape 104 is stepped, and the process is repeated. This is referred to as a step-and-repeat process. The total processing time required for forming a single pattern on the tape 104 may be on the order of a few seconds. As mentioned above, a single mask pattern may encompass an extended group of ablated features to reduce the processing time per nozzle member.

Laser ablation processes have distinct advantages over other forms of laser drilling for the formation of precision orifices, vaporization chambers, and ink channels. In laser ablation, short pulses of intense ultraviolet light are absorbed in a thin surface layer of material within about 1 micrometer or less of the surface. Preferred pulse energies are greater than about 100 millijoules per square centimeter and pulse durations are shorter than about 1 microsecond. Under these conditions, the intense ultraviolet light photodissociates the chemical bonds in the material. Furthermore, the absorbed ultraviolet energy is concentrated in such a small volume of material that it rapidly heats the dissociated fragments and ejects them away from the surface of the material. Because these processes occur so quickly, there is no time for heat to propagate to the surrounding material. As a result, the surrounding region is not melted or otherwise damaged, and the perimeter of ablated features can replicate the shape of the incident optical beam with precision on the scale of about one micrometer. In addition, laser ablation can also form chambers with substantially flat bottom surfaces which form a plane recessed into the layer, provided the optical energy density is constant across the region being ablated. The depth of such chambers is determined by the number of laser shots, and the power density of each.

Laser-ablation processes also have numerous advantages as compared to conventional lithographic electroforming processes for forming nozzle members for inkjet printheads. For example, laser-ablation processes generally are less expensive and simpler than conventional lithographic electroforming processes. In addition, by using laser-ablations processes, polymer nozzle members can be fabricated in substantially larger sizes (i.e., having greater surface areas) and with nozzle geometries that are not practical with conventional electroforming processes. In particular, unique nozzle shapes can be produced by controlling exposure intensity or making multiple exposures with a laser beam being reoriented between each exposure. Examples of a variety of nozzle shapes are described in co-pending application Ser. No. 07/658726, entitled "A Process of Photo-Ablating at Least One Stepped Opening Extending Through a Polymer Material, and a Nozzle Plate Having Stepped Openings," assigned to the present assignee and incorporated herein by reference. Also, precise nozzle geometries can be formed without process controls as strict as those required for electroforming processes.

Another advantage of forming nozzle members by laser-ablating a polymer material is that the orifices or nozzles can be easily fabricated with various ratios of nozzle length (L) to nozzle diameter (D). In the preferred embodiment, the L/D ratio exceeds unity. One advantage of extending a nozzle's length relative to its diameter is that orifice-resistor positioning in a vaporization chamber becomes less critical.

In use, laser-ablated polymer nozzle members for inkjet printers have characteristics that are superior to conventional electroformed orifice plates. For example, laser-ablated polymer nozzle members are highly resistant to corrosion by water-based printing inks and are generally hydrophobic. Further, laser-ablated polymer nozzle members have a relatively low elastic modules, so built-in stress between the nozzle member and an underlying substrate or barrier layer has less of a tendency to cause nozzle member-to-barrier layer delamination. Still further, laser-ablated polymer nozzle members can be readily fixed to, or formed with, a polymer substrate.

Although an Excimer laser is used in the preferred embodiments, other ultraviolet light sources with substantially the same optical wavelength and energy density may be used to accomplish the ablation process. Preferably, the wavelength of such an ultraviolet light source will lie in the 150 nm to 400 nm range to allow high absorption in the tape to be ablated. Furthermore, the energy density should be greater than about 100 millijoules per square centimeter with a pulse length shorter than about 1 microsecond to achieve rapid ejection of ablated material with essentially no heating of the surrounding remaining material.

As will be understood by those of ordinary skill in the art, numerous other processes for forming a pattern on the tape 104 may also be used. Other such processes include chemical etching, stamping, reactive ion etching, ion beam milling, and molding or casting on a photodefined pattern.

A next step in the process is a cleaning step wherein the laser ablated portion of the tape 104 is positioned under a cleaning station 117. At the cleaning station 117, debris from the laser ablation is removed according to standard industry practice.

The tape 104 is then stepped to the next station, which is an optical alignment station 118 incorporated in a conventional automatic TAB bonder, such as an inner lead bonder commercially available from Shinkawa Corporation, model number IL-20. The bonder is preprogrammed with an alignment (target) pattern on the nozzle member, created in the same manner and/or step as used to created the orifices, and a target pattern on the substrate, created in the same manner and/or step used to create the resistors. In the preferred embodiment, the nozzle member material is semi-transparent so that the target pattern on the substrate may be viewed through the nozzle member. The bonder then automatically positions the silicon dies 120 with respect to the nozzle members so as to align the two target patterns. Such an alignment feature exists in the Shinkawa TAB bonder. This automatic alignment of the nozzle member target pattern with the substrate target pattern not only precisely aligns the orifices with the resistors but also inherently aligns the electrodes on the dies 120 with the ends of the conductive traces formed in the tape 104, since the traces and the orifices are aligned in the tape 104, and the substrate electrodes and the heating resistors are aligned on the substrate. Therefore, all patterns on the tape 104 and on the silicon dies 120 will be aligned with respect to one another once the two target patterns are aligned.

Thus, the alignment of the silicon dies 120 with respect to the tape 104 is performed automatically using only commercially available equipment. By integrating the conductive traces with the nozzle member, such an alignment feature is possible. Such integration not only reduces the assembly cost of the printhead but reduces the printhead material cost as well.

The automatic TAB bonder then uses a gang bonding method to press the ends of the conductive traces down onto the associated substrate electrodes through the windows formed in the tape 104. The bonder then applies heat, such as by using thermo-compression bonding, to weld the ends of the traces to the associated electrodes. A schematic side view of one embodiment of the resulting structure is shown in FIG. 6. Other types of bonding can also be used, such as ultrasonic bonding, conductive epoxy, solder paste, or other well-known means.

The tape 104 is then stepped to a heat and pressure station 122. As previously discussed with respect to FIGS. 9 and 10, an adhesive layer 84 exists on the top surface of the barrier layer 30 formed on the silicon substrate. After the above-described bonding step, the silicon dies 120 are then pressed down against the tape 104, and heat is applied to cure the adhesive layer 84 and physically bond the dies 120 to the tape 104.

Thereafter the tape 104 steps and is optionally taken up on the take-up reel 124. The tape 104 may then later be cut to separate the individual TAB head assemblies from one another.

The resulting TAB head assembly is then positioned on the print cartridge 10, and the previously described adhesive seal 90 is formed to firmly secure the nozzle member to the print cartridge, provide an ink-proof seal around the substrate between the nozzle member and the ink reservoir, and encapsulate the traces in the vicinity of the headland so as to isolate the traces from the ink.

Peripheral points on the flexible TAB head assembly are then secured to the plastic print cartridge 10 by a conventional melt-through type bonding process to cause the polymer flexible circuit 18 to remain relatively flush with the surface of the print cartridge 10, as shown in FIG. 1.

The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims.

What is claimed is:

1. An ink cartridge for an inkjet printer comprising:

a nozzle member having a plurality of ink orifices formed therein;

a substrate containing a plurality of heating elements and associated ink ejection chambers, said substrate mounted on a back surface of said nozzle member, each heating element being located proximate to an associated ink orifice, said back surface of said nozzle member extending over two or more outer edges of said substrate;

a headland portion located proximate to the back surface of said nozzle member and including an inner raised wall circumscribing an inlet slot and having wall openings therein, said wall openings having a support surface with peninsulas extending therefrom toward the inlet slot; and an adhesive layer located between the back surface of said nozzle member and the inner raised wall to affix said nozzle member to said headland.

2. The ink cartridge of claim 1 wherein the top of the inner raised wall is adapted to accept an adhesive dispensed thereon.

3. The ink cartridge of claim 1 wherein the top of the inner raised wall has an indentation formed therein.

4. The ink cartridge of claim 3 wherein the indentation is a "V" shaped groove.

5. The ink cartridge of claim 1 wherein said headland portion includes adhesive ridges formed in an outer wall opposite the inner wall openings.

6. The ink cartridge of claim 1 wherein said headland portion includes downwardly sloping troughs adjacent the support surface.

7. The ink cartridge of claim 1 wherein said adhesive layer is located on the inner raised wall and along the support surface within the wall openings therein.

8. The ink cartridge of claim 1 wherein said inlet slot is in fluidic communication with an ink reservoir body.

9. The ink cartridge of claim 1 wherein said adhesive layer also forms a fluidic seal between said headland and the back surface of said nozzle member.

10. The ink cartridge of claim 1 wherein said nozzle member is formed of a flexible polymer material.

11. The ink cartridge of claim 1 wherein said nozzle member is a rigid plate.

12. The ink cartridge of claim 1 wherein said adhesive also encapsulates conductive traces affixed to said nozzle member and bonded to electrodes on said substrate.

13. A method of affixing a nozzle member to an inkjet print cartridge body comprising the steps of:

affixing a substrate containing a plurality of heating elements and associated ink ejection chambers to a back surface of a nozzle member containing a plurality of orifices, the back surface of the nozzle member extending over two or more outer edges of the substrate;

providing a headland portion including an inner raised wall circumscribing an inlet slot and having wall openings therein, the openings having a support surface with peninsulas extending therefrom toward the inlet slot;

dispensing an adhesive on the inner raised wall and across the wall openings therein to circumscribe the inlet slot; and positioning the back surface of the nozzle member with respect to the headland such that the adhesive circumscribes the substrate and affixes the back surface of the nozzle member to the headland.

14. The method of claim 13 wherein in said providing step the top of the inner raised wall is adapted to accept an adhesive dispensed thereon.

15. The method of claim 13 wherein in said providing step the top of the inner raised wall has an indentation formed therein.

16. The method of claim 13 wherein the indentation is a "V" shaped groove.

17. The method of claim 13 wherein in said providing step the headland portion further includes adhesive ridges formed in an outer wall opposite the inner wall openings.

18. The method of claim 13 wherein in said providing step the headland portion further includes downwardly sloping troughs adjacent the support surface.

19. The method of claim 13 whereto said adhesive layer is dispensed on the inner raised wall and along the support surface within the wall openings therein.

20. The method of claim 13 wherein in said providing step the inlet slot is in fluidic communication with an ink reservoir body.

21. The method of claim 13 wherein in said positioning step the adhesive layer also forms a fluidic seal between the headland and the back surface of the nozzle member.

22. The method of claim 13 wherein in said affixing step said nozzle member is formed of a flexible polymer material.

23. The method of claim 13 wherein in said affixing step the nozzle member is a rigid plate.

24. The method of claim 13 wherein in said positioning step the adhesive also encapsulates conductive traces affixed to the nozzle member and bonded to electrodes on the substrate.

* * * * *